United States Patent [19]

Hope et al.

[11] Patent Number: 4,506,193

[45] Date of Patent: Mar. 19, 1985

[54] THIN FILM ELECTROLUMINESCENT DISPLAY

[75] Inventors: Lawrence L. Hope, Stow; John L. Plumb, Danvers, both of Mass.

[73] Assignee: GTE Products Corporation, Stamford, Conn.

[21] Appl. No.: 657,057

[22] Filed: Oct. 3, 1984

Related U.S. Application Data

[63] Continuation of Ser. No. 431,976, Sep. 30, 1982, abandoned.

[51] Int. Cl.[3] ..... H05B 37/00; G09F 9/00

[52] U.S. Cl. ..... 315/169.3; 315/71; 340/752; 340/760; 340/781

[58] Field of Search ..... 315/71, 169.3; 340/752, 340/760, 781

[56] References Cited

U.S. PATENT DOCUMENTS 3,154,720 10/1964 Cooperman ..... 340/781
3,379,927 4/1968 Vando ..... 315/169.3
3,461,344 8/1969 Rich ..... 315/169.3
3,504,214 3/1970 Lake et al. ..... 315/169.3

OTHER PUBLICATIONS

"El Panel Driver" by Norman P. Huffnagle Popular Electronics May 1971, pp. 43–48.

*Primary Examiner*—Harold Dixon
*Attorney, Agent, or Firm*—Edward J. Coleman; José W. Jimenez

[57] ABSTRACT

In an electroluminescent display device, an integral thin film resistor means including a plurality of discrete thin film resistors formed by thin film deposition and having a resistor in series and associated with each driven segment. In the preferred device the thin film resistors are deposited in a predetermined pattern on the back glass in conjunction with back glass electrode deposition whereby electrical connection is made to the electroluminescent device at the back glass.

17 Claims, 2 Drawing Figures

THIN FILM ELECTROLUMINESCENT DISPLAY

This application is a continuation of application Ser. No. 431,976, filed Sept. 30, 1982, now abandoned.

BACKGROUND OF THE INVENTION

The present invention relates in general to thin film electroluminescent displays and is concerned, more particularly, with an improved electroluminescent display having integral thin film resistors associated therewith.

AC electroluminescent thin film displays are fabricated by the successive deposition of several thin film layers on a glass substrate. The display also has patterned electrodes formed by proper mask selection as thin film electrodes, and a protective back glass substrate which is sealed to the base glass substrate by a hermetic seal material usually disposed in the shape of a picture frame. The aforementioned patterned electrodes are typically in the form of two thin films including a transparent front electrode and a rear electrode or counterelectrode. These conducting films extend under the sealing material between the two substrates of glass to the edge of the display where external electrical contact is made. Presently, connection is made externally to series resistors, one per display segment, or connection may be made to electronic multiplexing circuitry. There is thus required, external of the display device, a number of resistors (one per display segment) which adds greatly to the number of separate discrete electronic parts for the entire circuitry associated with the electroluminescent display device. Even in a multiplexing scheme connection is still made to each display segment and although there may be some savings in the number of external resistors required, there is still a requirement for a number of external resistors associated with the display device. Moreover, regardless of the form of segment selection, it is desired to provide optimum current limiting protection, in which case it is desired to have a resistor in series with each segment.

SUMMARY OF THE INVENTION

Accordingly, it is an object of the present invention to provide an improved thin film electroluminescent display with integral thin film resistors.

Another object of the present invention is to provide an improved thin film electroluminescent display having integral thin film resistors for current limiting purposes. The construction of the display of this invention eliminates the need for having separate discrete component resistors.

A further object of the present invention is to provide an improved thin film electroluminescent display as in accordance with the preceding objects and in which the thin film resistors are preferably deposited on the back glass substrate.

To accomplish the foregoing and other objects of this invention, there is provided an electroluminescent display device having a substrate upon which a plurality of layers are deposited including patterned electrode segments and active layer means. The display device also includes a back glass and conductive means coupling to the patterned electrode segments to enable electrical connection thereto. The improvement in accordance with the present invention is concerned with providing thin film resistor means integrally formed with the display device and including at least one thin film resistor associated with each electrode segment. Each thin film resistor is arranged in circuit with the conductive means that couples from the electrode segment to a contact tab on the device to which electrical connection is made. In accordance with the preferred embodiment of the present invention, the thin film resistors are deposited such as by sputtering on the back glass on the side thereof that faces the base substrate. These resistors are deposited so that there is one resistor per display segment. The thin film resistor material may be, for example, nichrome, an alloy or nickel and chromium, deposited by sputtering to a sheet resistance on the order of 100 ohms per square.

BRIEF DESCRIPTION OF THE DRAWINGS

Numerous other objects, features and advantages of the invention should now become apparent upon a reading of the following detailed description taken in conjunction with the accompanying drawing, in which.

DESCRIPTION OF THE PREFERRED EMBODIMENT

Figure 1:
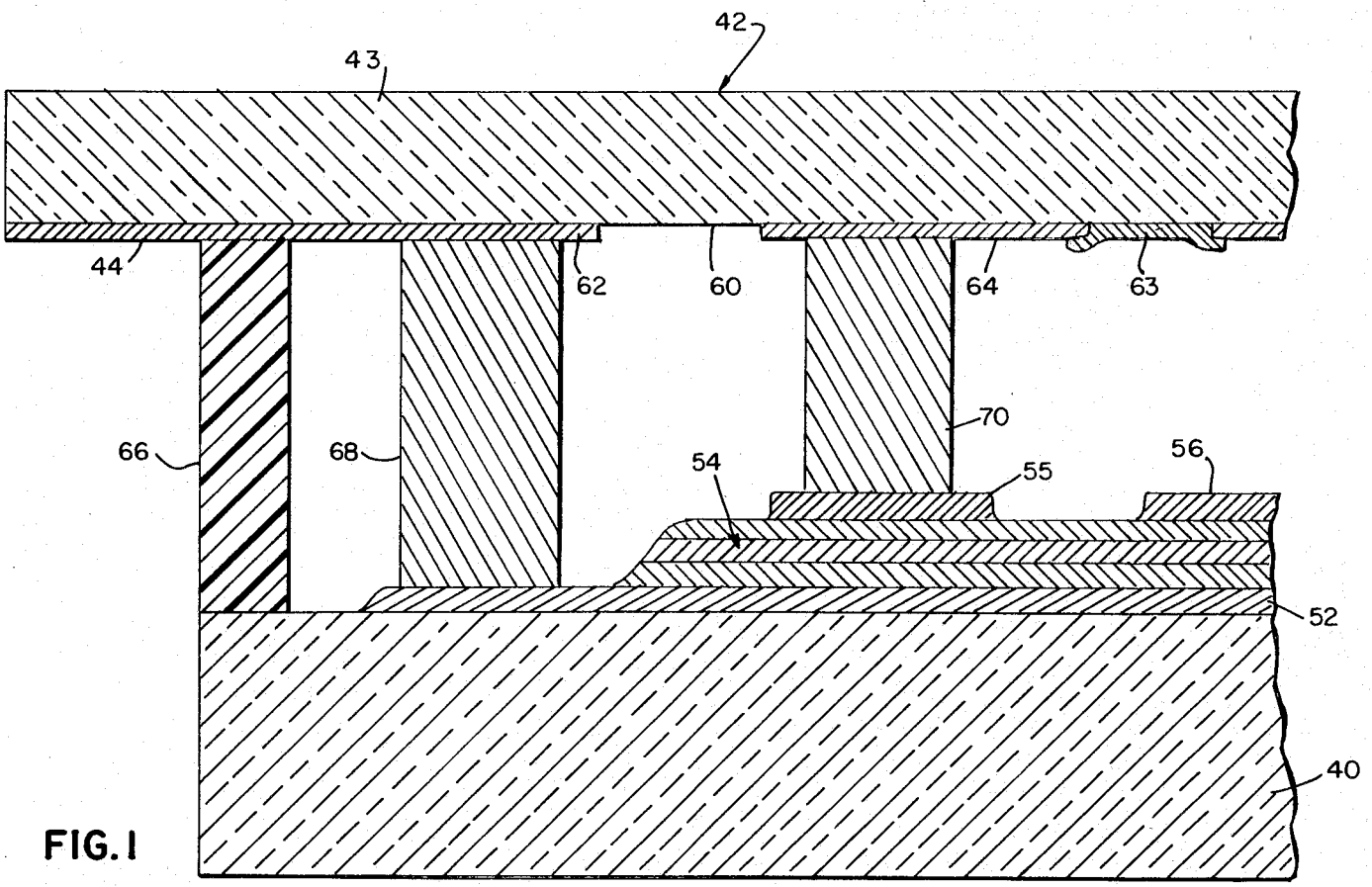
FIG. 1 is a detailed cross-sectional view showing some layers exaggerated in thickness but illustrating the integral thin film resistor concepts of the present invention.
Figure 2:
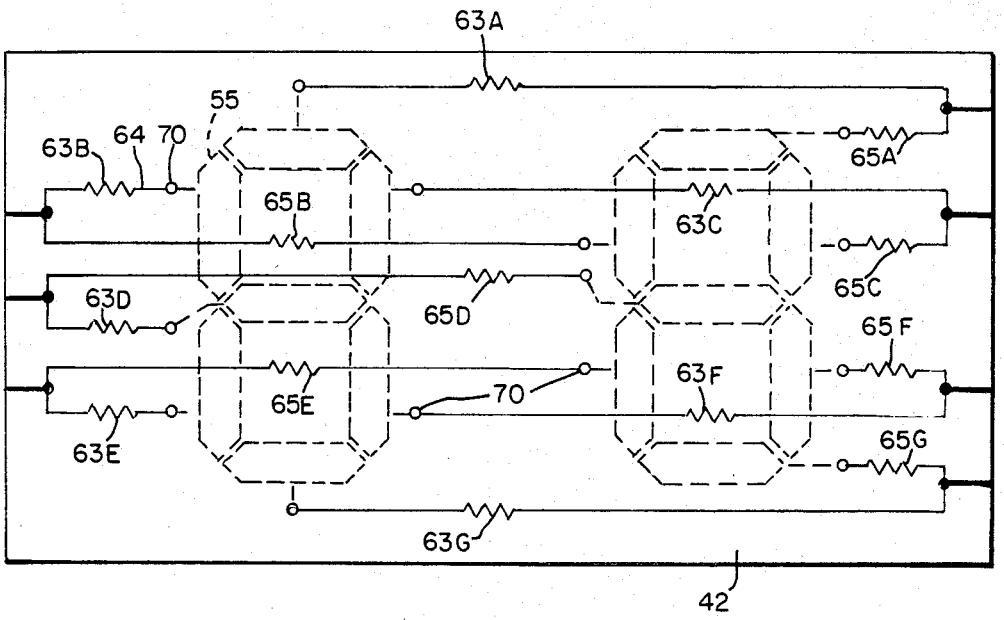
FIG. 2 schematically illustrates one resistor layout for a two-digit display.

With reference to the drawings, there is shown in FIG. 1 a cross-sectional detail depicting the manner in which the integral thin film resistors are arranged. FIG. 2 is a schematic view illustrating a typical resistor layer. Because FIG. 1 is a cross-sectional view, not all of the resistors are shown in FIG. 1. Also, in the embodiment described in FIG. 1, the internal connections are brought out at the back glass.

FIG. 1 illustrates a fragmentary portion of an electroluminescent display device which includes a substrate 40 with a front electrode system 52 deposited thereon. There are a series of active layers 54 deposited over the front electrode system 52. In FIG. 1 three such layers are shown. These may include one or more dielectric layers, certainly a phosphor layer, and perhaps a dark field layer. The patterned counterelectrode system is disposed over the active layers 54. In the illustration of FIG. 1 this counterelectrode system is shown as including rear electrode segments 55 and 56. The front electrode system 52, active layers 54, and the counterelectrode system may be formed by conventional deposition techniques.

In FIG. 1 the back glass 42 is shown having deposited thereon on its front surface 60, conductive means consisting of a back plane electrode system including, for example, back electrodes 62 and 64. The conductive electrode 62 is illustrated terminating in a contact pad 44. FIG. 1 also illustrates the hermetic seal 66 and conductive interconnection means 68 and 70. The interconnection means 68 couples the front electrode system 52 to the back electrode 62 and associated contact pad 44. The interconnection means 70 is shown connecting one of the display electrode segments 55 to the electrode, or conductive, connection 64 of the back plane electrode system.

The internal connections, such as interconnection means 68 and 70 such as shown in FIG. 1 may be made by one of several different techniques, such as, for example, with the use of small areas or pieces of conductive epoxy or conductive foil. Alternatively, a solder technique may be used. If conductive epoxy is employed, it may be of the same chemical family as the peripheral seal 66 which is usually of an epoxy material. However, the conductive epoxy incorporates silver or other conductive material dispersed in it. This may be applied in the same manner as the hermetic seal 66, possibly as preforms with the same thickness and hardening properties as the seal, or it may be applied in a silk screen process. In one application, in both the seal epoxy and the conductive epoxy are applied in advance to the back glass, upon which has been previously deposited, the appropriate system of back plane electrodes including, for example, electrodes 62 and 64 shown in FIG. 1. Also, on the back glass are deposited tab pads for external contact, such as the contact pad 44 shown in FIG. 1. Then the sub-assembly of back glass, seal, and conductive epoxy is joined under heat to the completed display substrate with layers and electrodes applied thereto to form the device illustrated in FIG. 1.

Now, in accordance with the present invention, in FIG. 1 there is illustrated disposed in circuit with the electrode 64, a thin film resistor 63. For example, this may be provided, as shown in FIG. 1, by interrupting conductive electrode 64 to form a gap across which the thin film resistor 63 is deposited. Alternately, the thin film resistor 63 may be deposited first, then the conductive thin film (electrode 64) may be deposited as a pair of spaced portions each contacting a respective end of resistor 63. In this way, the thin film resistor 63 actually electrically couples from the electrode segment 55 out to a contact pad not illustrated in FIG. 1. Although not illustrated in FIG. 1, there may also be provided a thin film resistor associated with the electrode 62. Each of the thin film resistors may connect through conductor thin film to an external contact, or resistors may be ganged together and connected to a common contact for external connection to multiplexing circuitry. In either case, maximum current limiting protection is provided to each display segment.

The thin film resistor material may be, for example, Nichrome, which is the trademark of an alloy of nickel and chromium deposited by sputtering to a sheet resistance of about 100 ohms per square. The resistance of each resistor is preferably about 100 K ohms and therefore each resistor is approximately 1000 squares in length. Other resistor materials that may be used include SiO—Cr, $TaN_2$, or $SnO_2$. Any resistor material that can be deposited to a sheet resistance sufficiently high to achieve resistances of about 100 K ohms may be employed.

FIG. 2 illustrates an example of the layout of a two-digit display. FIG. 2 illustrates the segment 55, also shown in FIG. 1, showing a resistor 63B coupled therefrom. It is noted that there is also a second resistor 65B coupled in common with resistor 63B and coupling to a like segment of the right hand digit illustrated in FIG. 2. For the seven segment display illustrated in FIG. 2, there are resistors 63A–63G associated with the left hand digit and resistors 65A–65G associated with the right hand digit in FIG. 2. FIG. 2 also illustrates, associated with the one segment 55, the interconnection point 70 coupling to electrode 64 illustrated in the schematic view of FIG. 2 by a simple length of conductor. Thus, in FIG. 2 each of the nodes 70 represent an interconnection such as the interconnection means 70 illustrated in FIG. 1 for connection between substrates.

Having described one embodiment of the present invention, it should now be apparent to those skilled in the art that numerous other embodiments are contemplated as falling within the scope of this invention.

What is claimed is:

1. In an electroluminescent display device having a substrate. a plurality of layers deposited on said substrate including patterned electrode segments and active layer means, a back glass and conductive means coupled to said patterned electrode segments to enable electrical connection thereto, the improvement comprising thin film resistor means disposed in circuit with said conductive means, said thin film resistor means including at least one thin film resistor associated with each of said electrode segments, said thin film resistor means comprised of a material selected from the group consisting of SiO—Cr, $TaN_2$, $SnO_2$, and an alloy of nickel and chromium.

2. The improvement according to claim 1 wherein said thin film resistor is deposited on said back glass.

3. The improvement according to claim 1 wherein said thin film resistor is deposited to a sheet resistance of about one hundred ohms per square.

4. The improvement according to claim 1 wherein said thin film resistor has a value of about one hundred-thousand ohms.

5. The improvement according to claim 1 wherein said thin film resistor and at least part of said conductive means are deposited on the side of said back glass facing said substrate.

6. The improvement according to claim 1 wherein said thin film resistor means includes a plurality of thin film resistors deposited on the side of said back glass facing said substrate, each of said resistors being disposed in circuit with said conductive means and providing electric current limitation to each of said electrode segments.

7. The improvement according to claim 6 wherein an electrode film, forming at least part of said conductive means, is deposited on said back glass, said film including contact tab means.

8. In an electroluminescent display device having a substrate, a plurality of layers deposited on said substrate including patterned electrode segments and active layer means, a back glass and conductive means coupled to said patterned electrode segments to enable electrical connection thereto, the improvement comprising thin film resistor means disposed in circuit with said conductive means, said thin film resistor means including at least one thin film resistor associated with each of said electrode segments, said thin film resistor being deposited on said back glass.

9. The improvement according to claim 8 wherein said thin film resistor means is comprised of a material selected from the group consisting of SiO—Cr, $TaN_2$, $SnO_2$, and an alloy of nickel and chromium.

10. The improvement according to claim 8 wherein said thin film resistor is deposited to a sheet resistance of about one hundred ohms per square.

11. The improvement according to claim 8 wherein said thin film resistor has a value of about one hundred-thousand ohms.

12. The improvement according to claim 8 wherein said thin film resistor means includes a plurality of thin film resistors deposited on the side of said back glass facing said substrate, each of said resistors being disposed in circuit with said conductive means and providing electric current limitations to each of said electrode segments.

13. The improvement according to claim 12 wherein an electrode film, forming at least part of said conductive means, is deposited on said back glass, said film including contact tab means.

14. In a hermetically sealed electroluminescent display device having a substrate, a plurality of layers deposited on said substrate including patterned electrode segments and active layer means, said active layer means including a phosphor layer, a back glass spaced from and substantially parallel to said substrate, said device including conductive means, the improvement comprising thin film resistor means disposed in circuit with said conductive means and deposited on said back glass facing said substrate, said thin film resistor means including at least one thin film resistor associated with and providing electric current limitation to each of said electrode segments, a plurality of back electrodes disposed on said back glass, said plurality of layers also including transparent front electrodes and said conductive means located between said substrate and said back glass, said conductive means coupling at least one of said front electrodes or electrode segments to at least one of said back electrodes.

15. The improvement according to claim 14 wherein said thin film resistor means is comprised of a material selected from the group consisting of SiO—Cr, $TaN_2$, $SnO_2$, and an alloy of nickel and chromium.

16. The improvement according to claim 14 wherein said thin film resistor is deposited to a sheet resistance of about one hundred ohms per square.

17. The improvement according to claim 14 wherein said thin film resistor has a value of about one hundred-thousand ohms.

* * * * *